US008808122B2

(12) United States Patent
Lopatka

(10) Patent No.: US 8,808,122 B2
(45) Date of Patent: Aug. 19, 2014

(54) CUP INSULATING SLEEVE FLYING CYLINDRICAL TOY ATTACHMENT

(75) Inventor: Reid Lopatka, Bristol, WI (US)

(73) Assignee: Daddy-O-Endeavors LLC, Bristol, WI (US)

( * ) Notice: Subject to any disclaimer, the term of this patent is extended or adjusted under 35 U.S.C. 154(b) by 260 days.

(21) Appl. No.: 13/162,656

(22) Filed: Jun. 17, 2011

(65) Prior Publication Data

US 2012/0267854 A1 Oct. 25, 2012

Related U.S. Application Data

(60) Provisional application No. 61/476,792, filed on Apr. 19, 2011.

(51) Int. Cl.

| | |
|---|---|
| ***A63H 33/18*** | (2006.01) |
| ***A63B 65/00*** | (2006.01) |
| ***A63B 67/06*** | (2006.01) |
| *A63B 67/18* | (2006.01) |

(52) U.S. Cl.

CPC ..... *A63B 67/06* (2013.01); *A63B 2243/007* (2013.01); *A63B 67/18* (2013.01)

USPC ..... 473/589; 446/61

(58) Field of Classification Search

USPC ..... 473/588, 589; 446/61, 71; 220/739

See application file for complete search history.

(56) References Cited

U.S. PATENT DOCUMENTS

| | | | | | |
|---|---|---|---|---|---|
| 3,264,776 | A | * | 8/1966 | Morrow | 446/34 |
| 4,151,674 | A | * | 5/1979 | Klahn et al. | 446/34 |
| 4,246,721 | A | * | 1/1981 | Bowers | 446/61 |
| 4,390,148 | A | * | 6/1983 | Cudmore | 244/19 |
| 4,790,788 | A | * | 12/1988 | Hill | 446/61 |
| 5,067,922 | A | * | 11/1991 | McMahon | 446/71 |
| 5,152,709 | A | * | 10/1992 | Johnson et al. | 446/71 |
| 5,397,261 | A | * | 3/1995 | Malewicki et al. | 446/71 |
| D364,431 | S | * | 11/1995 | Diecidue et al. | D21/444 |
| 5,810,637 | A | * | 9/1998 | Mileti | 446/61 |
| 5,816,880 | A | * | 10/1998 | Forti et al. | 446/61 |
| 6,048,245 | A | * | 4/2000 | Forti et al. | 446/61 |
| 6,244,980 | B1 | * | 6/2001 | Depcik | 473/613 |
| 6,679,748 | B2 | * | 1/2004 | Forti et al. | 446/34 |
| 6,814,253 | B2 | * | 11/2004 | Wong | 220/739 |
| 7,694,843 | B2 | * | 4/2010 | Hollis et al. | 220/703 |
| D642,633 | S | * | 8/2011 | Walterscheid | D21/444 |
| 8,246,497 | B1 | * | 8/2012 | Garcia | 473/613 |
| 2005/0056654 | A1 | | 3/2005 | Leung | |
| 2005/0230466 | A1 | | 10/2005 | Prescott | |
| 2009/0266825 | A1 | | 10/2009 | O'Keefe | |

OTHER PUBLICATIONS

Product Advertisement for Best Flying Toy by X-zylo, xzylo.com 2009.

Product Advertisment for Toobee, Toobee.Amazing Flying Can., Toobee International, P.O. Box 166, Sussex, WI 53089 USA, 2008.

* cited by examiner

*Primary Examiner* — Raleigh W Chiu

(74) *Attorney, Agent, or Firm* — Eugene M. Cummings, P.C.

(57) ABSTRACT

An aerial toy is formed by coupling a ring to an insulating sleeve used with disposable paper cups. The ring is attached to the smaller diameter conical end of the insulator sleeve creating a flying gyroscope. The flight of the toy is protracted due to the airfoil characteristics of the tubular body and is thrown like a football for distance, accuracy, fun and competition.

5 Claims, 4 Drawing Sheets

CUP INSULATING SLEEVE FLYING CYLINDRICAL TOY ATTACHMENT

CROSS-REFERENCE TO RELATED APPLICATION

This application claims benefit under 35 U.S.C. §119(e) of U.S. Provisional Application entitled "A CUP INSULATING SLEEVE FLYING CYLINDRICAL TOY ATTACHMENT", filed Apr. 19, 2011, having Ser. No. 61/476,792, naming Reid Lopatka as inventor, the complete disclosure thereof being incorporated herein by reference.

BACKGROUND OF THE DISCLOSURE

I. Field of the Disclosure

The present disclosure relates generally to a ring adapted to be fitted on the end of a beverage insulating sleeve. In particular, the ring is designed to attach on the end of a beverage cup insulating sleeve thereby creating an aerial toy with the weighted ring end forward.

II. Description of the Prior Art

Disposable cups are routinely used in coffee shops, fast food and take-out restaurants to contain hot drinks. Such cups are of standardized sizes, normally frustro-conical in shape and having an upwardly open top rim adapted to receive one of several standard sizes of plastic lid. These cups are also generally made from wax-covered paper, paperboard and/or polystyrene. While polystyrene is an excellent thermal insulator, it is not easily recyclable or biodegradable and thus has fallen out of favor. On the other hand, paper and paperboard are easily recyclable and biodegradable but are poor thermal insulators. As a result, because cups made from paper and paperboard materials have relatively thin walls, when they are filled with a hot beverage, such as coffee, tea or soup, they are difficult to handle comfortably due to the elevated temperature of the contents in the paper cup.

In an effort to provide adequate insulation for comfortable handling of a paper cup, and rather than "double-cup" (i.e. use two nested cups instead of a single cup), there have been numerous versions of an insulating sleeve for holding the cup. These sleeves are frequently made from a paperboard blank that is configured to closely embrace the paper cup and protect the user's fingers from high temperatures. These sleeves, while comprising of less material than a second paper cup, are still nevertheless disposable and are typically used as a one-time consumable together with the cup. Accordingly, such sleeves represent a burden on the environment.

Toys, such as model airplanes, kites, boomerangs and Frisbees® have been known for many years. Of more recent popularity, are aerial toys made of simple tubular bodies that can be thrown and whose flight is protracted because the tube exhibits airfoil characteristics. These flying gyroscopes are thrown for distance, accuracy, fun and competition. Typical brand name flying gyroscopes include TooBee® and X-zylo™. These and other brands tend to be somewhat fragile as well as relatively expensive.

Accordingly, it is a general object of the present disclosure to provide another use for the generally one-time consumable insulating cup sleeve.

It is a more specific object of the present disclosure to use the insulating cup sleeve as an aerial toy.

It is another specific object of this disclosure to provide a ring in combination with the insulating cup sleeve to form a flying gyroscope toy.

These and other objects, features and advantages of the disclosure will be clearly understood through a consideration of the following detailed description.

SUMMARY OF THE DISCLOSURE

According to one embodiment of the present disclosure, there is provided a ring for use with an insulating cup holder having an open larger diameter conical end and an open smaller diameter conical end to form an aerial toy. The ring is coupled to one of the ends of the sleeve and forms a weighted leading edge for the toy.

There is also provided an aerial toy including an insulating cup holder having an open larger diameter conical end and an open smaller diameter conical end in combination with a weighted ring adopted to couple to one of said ends of said holder.

There is further provided a ring for use with an insulating cup holder having an open larger diameter conical end and an open smaller diameter conical end to form an aerial toy. The ring includes an outer wall and an inner wall defining a channel therebetween for receiving one of said ends of said holder.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

Figure 1A:
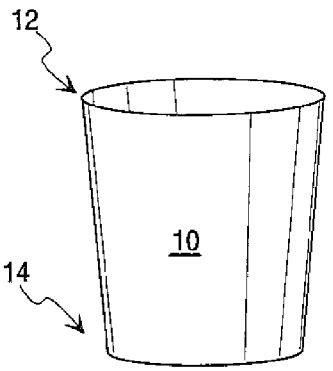
FIG. 1*a* is a side view of a typical disposable paper cup.
Figure 1B:
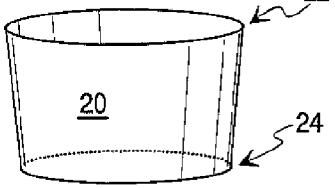
FIG. 1*b* is a side view of a typical insulator sleeve.
Figure 1C:
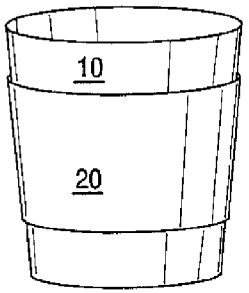
FIG. 1*c* is a side view of the typical usage of the insulator sleeve over the disposable paper cup.

As shown in FIG. 1*a*, a typical disposable paper cup 10 has an open larger diameter conical end 12 for content pouring and consuming, and a closed smaller diameter conical end 14. A typical insulator sleeve 20, as shown in FIG. 1*b*, has an open larger diameter conical end 22 and an open smaller diameter conical end 24. FIG. 1*c* shows the typical usage of the insulator sleeve 20 over the paper cup 10.

Figure 2A:
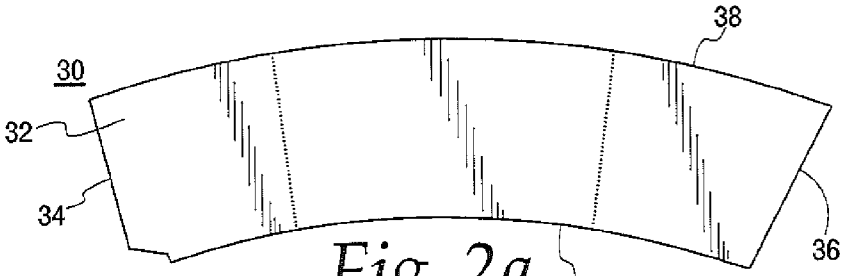
FIG. 2*a* is a side view of a paper blank from which a conventional insulating cup sleeve is made.
Figure 2B:
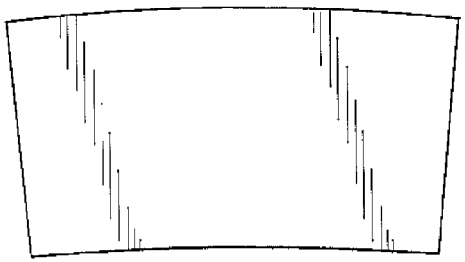
FIG. 2*b* is a side view of the sleeve of FIG. 2*a* shown in a folded configuration.
Figure 2C:
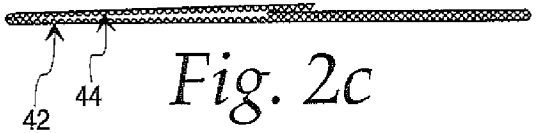
FIG. 2*c* is a top view of the folded sleeve of FIG. 2*b*.

As shown in FIGS. 2*a*-2*c*, a conventional insulating cup holder 30 is typically formed from a paperboard blank 32, having a first end 34 and a second end 36, together with an arcuate top edge 38 and an arcuate bottom edge 40. The paperboard can have a smooth surface 42 and a corrugated surface 44, two smooth surfaces or two corrugated surfaces. When the ends 34, 36 have been adhered together, the blank may be folded for storage and shipping; see FIGS. 2*b* and 2*c*.

Conversely, when the blank is formed into an assembled configuration, the holder forms a tapered sleeve that may be positioned about a tapered container; see FIGS. 1*b* and 1*c*.

The ring 50 is adapted to slip-fit onto one of the conical ends 22, 24 of the sleeve. For example, the ring is fitted on the smaller diameter conical end 24 of the insulator sleeve 20 as shown in an enlarged perspective view in FIG. 3. This rim, band, circlet or ring 50 is preferably made of a pliable plastic rubber material that is in the shape of a circle from a perpendicular view, and the shape of a "U" from a cross-sectional view. The ring 50 is preferably 2½ to 3¼ in diameter 52 and ½ to 1½ tall on the outside perimeter 54. Accordingly, the ring 50 is dimensioned so as to be fitted around the end of a standard sized insulating sleeve, but can be customarily sized as necessary. The outside perimeter 54 can be adaptable to receive print and/or the ability to receive so-called dry erase markings.

Figure 3:
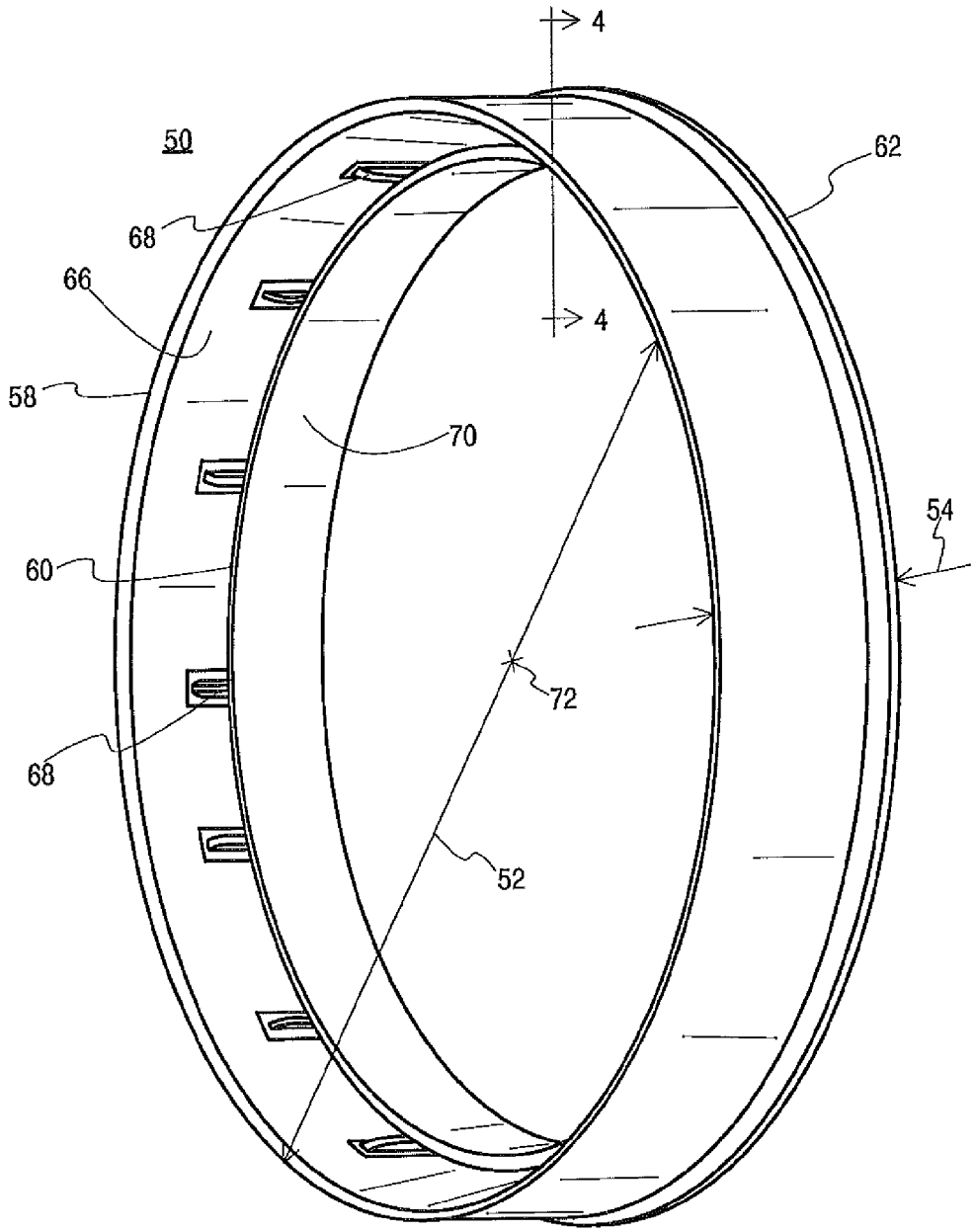
FIG. 3 is an enlarged perspective view of the ring incorporating an aspect of the present disclosure.
Figure 4:
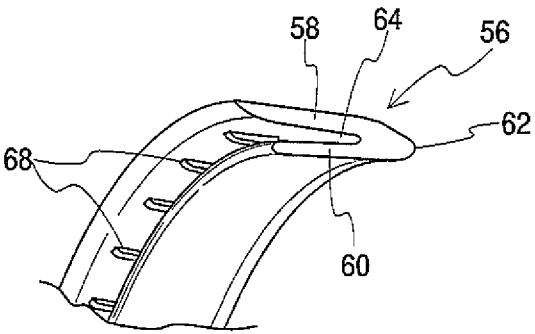
FIG. 4 is a cross-sectional view of the ring taken along lines 4-4 of FIG. 3.

Referring to FIG. 4 in conjunction with FIG. 3, the "U" shape 56 is formed where the outer wall 58 and the inner wall 60 meet at the leading edge 62 of the ring 50. It is the channel 64 between the walls that receives the smaller diameter conical end 24 of the insulator sleeve 20. The inside surface 66 of the outer wall 58 includes a plurality of protrusions 68 for retaining the sleeve 20 within the channel 64 of the ring 50. The outside surface 70 of the inside wall 60 can be tapered towards the center 72 of the ring 50 away from the leading edge 62. It is the size of the inner wall and/or the taper that will aid in the airfoil characteristics of the toy by minimizing any wind resistance issues that may be caused by a corrugated inside surface of the insulator sleeve 20.

While an embodiment describing a "U" shaped circlet has been shown and described, it will be appreciated that other forms of a weighted leading edge ringlet are envisioned. For example, other means of coupling the weighted ring to the leading edge of the sleeve can be used. Such coupling can be to the inside surface of the sleeve, the outside surface, or both. So long as the ring is adapted to receive a conical end the insulator sleeve to improve the flying characteristics of the sleeve/ring aerial toy combination.

Figure 5:
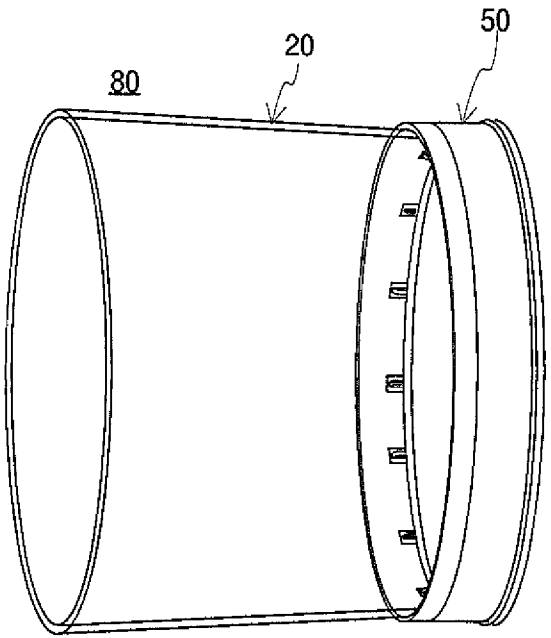
FIG. 5 is a perspective view of the ring of FIG. 3 coupled to an insulator sleeve.
Figure 6:
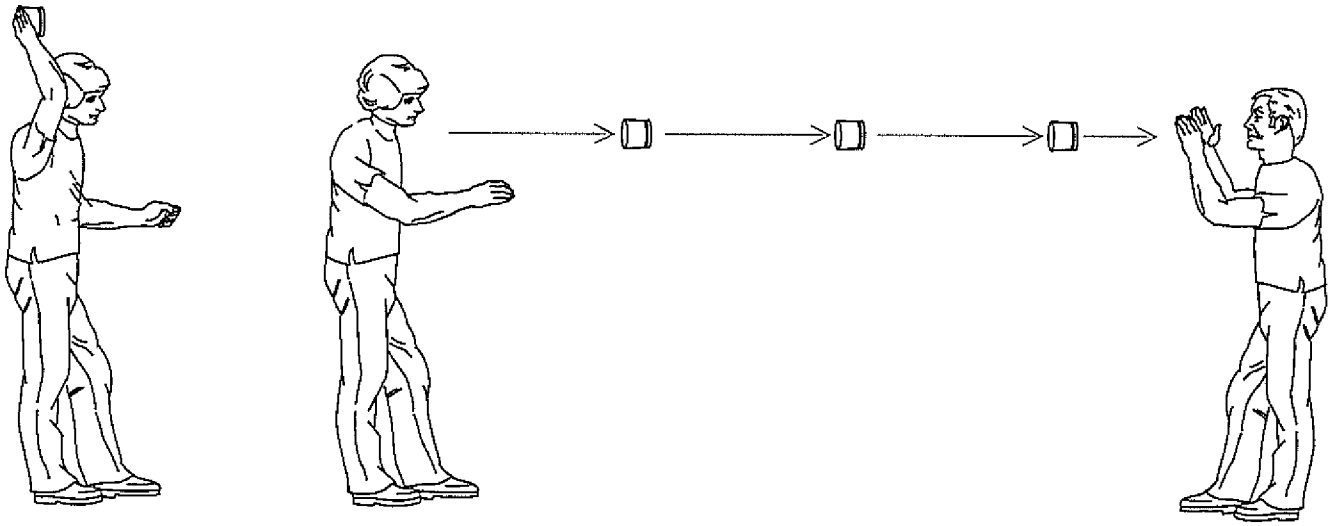
FIG. 6 is a side view of a user throwing the combination ring and insulator sleeve aerial toy.

As shown in FIGS. 5 and 6, the aerial toy 80 is formed when the insulator sleeve 20 is coupled to the ring 50. The toy 80 is picked up like a can and thrown like a football with the weighted ring end forward and spiraling. The thin walled sleeve 20 provides the lift and the directional stability of the toy 80, while the stronger ring 50 provides the structural strength and improves the flying characteristics of the toy 80. Air flow is improved by the high and/or tapered inside wall 60 and ensures a uniform flight regardless of any corrugated surfaces of the sleeve 20.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the disclosure if its broader aspects, and, therefore, the aim in the appended claims is to cover ail such changes and modifications as fall within the true spirit and scope of the present disclosure.

What is claimed is:

1. A two piece aerial toy comprising a disengageable combination of a ring and a disposable paperboard insulating cup sleeve, the sleeve being foldable and having a collapsed folded condition and an unfolded open condition, the sleeve having an open larger diameter conical end and an open smaller diameter conical end, the ring having a leading edge and an outer wall and an inner wall, the outer wall and the inner wall each having an outside surface and an inside surface and the inside surface of the outer wall and the inside surface of the inner wall defining a channel therebetween for receiving and frictionally retaining one of two ends of the open sleeve wherein the ring and the open sleeve combine to form a two-piece aerial toy, and wherein the ring and the cup holder disengage for sleeve disposal.

2. The two-piece aerial toy as defined in claim 1 wherein the ring is coupled to the smaller diameter conical open end of the sleeve.

3. The two-piece aerial toy as defined in claim 1 wherein the ring includes an outside perimeter adapted to receive print.

4. The two-piece aerial toy as defined in claim 1 wherein the ring is a pliable plastic rubber.

5. The two-piece aerial toy as defined in claim 1 wherein the inner surface of the channel has one or more protrusions for retaining one of the open ends of the sleeve within the channel.

* * * * *